US012796745B2

(12) United States Patent
Choi

(10) Patent No.: US 12,796,745 B2
(45) Date of Patent: Nov. 17, 2026

(54) SMOKING DEVICE WITH MAIN UNIT HAVING A RESILIENT LATCHING MEMBER

(71) Applicant: Philip Morris Products S.A., Neuchatel (CH)

(72) Inventor: Jueun Choi, Berkeley, CA (US)

(73) Assignee: Philip Morris Products S.A., Neuchatel (CH)

( * ) Notice: Subject to any disclaimer, the term of this patent is extended or adjusted under 35 U.S.C. 154(b) by 725 days.

(21) Appl. No.: 17/769,468

(22) PCT Filed: Oct. 16, 2020

(86) PCT No.: PCT/EP2020/079272
§ 371 (c)(1),
(2) Date: Apr. 15, 2022

(87) PCT Pub. No.: WO2021/089304
PCT Pub. Date: May 14, 2021

(65) Prior Publication Data

US 2022/0395031 A1 Dec. 15, 2022

(30) Foreign Application Priority Data

Oct. 17, 2019 (EP) ..... 19203865

(51) Int. Cl.
*A24F 40/95* (2020.01)
*A24F 40/20* (2020.01)
*A24F 40/40* (2020.01)

(52) U.S. Cl.
CPC ..... *A24F 40/95* (2020.01); *A24F 40/40* (2020.01); *A24F 40/20* (2020.01)

(58) Field of Classification Search
None
See application file for complete search history.

(56) References Cited

U.S. PATENT DOCUMENTS

2015/0305464 A1 10/2015 Nelson, Jr. et al.
2016/0091194 A1* 3/2016 Liu ..... A24F 40/95 206/265

(Continued)

FOREIGN PATENT DOCUMENTS

CN 205512351 U 8/2016
CN 207836767 U 9/2018

(Continued)

OTHER PUBLICATIONS

Zhan, Machine Translation of CN 110279154 A Specification, 2019, EPO and Google, pp. 1-9 (Year: 2019).*

(Continued)

*Primary Examiner* — Philip Y Louie
*Assistant Examiner* — Jeffrey A. Buckman
(74) *Attorney, Agent, or Firm* — Oblon, McClelland, Maier & Neustadt, L.L.P.

(57) ABSTRACT

A holder for an aerosol-generating device is provided, the holder including: a docking arrangement to engage with the device and including a docking space defined between a first end and an opposing second end spaced from and fixed relative to the first end, the docking space accommodating a longitudinal dimension of the device; and a retainer to engage with an end of the device to releasably retain the device in the docking space, the retainer having a first surface fixed relative to the first end, and a second surface projecting away from the first end into the docking space, the second surface being deflectable relative to the first end on engagement with the end of the device, the second surface includes a resiliently deformable elastic or elastomeric material, which includes a nitrile, and resilient deformation of the material allows the second surface to be deflectable relative to the first end.

17 Claims, 3 Drawing Sheets

(56) References Cited

U.S. PATENT DOCUMENTS

| | | | | |
|---|---|---|---|---|
| 2016/0120223 | A1* | 5/2016 | Keen | A24F 47/00 131/329 |
| 2017/0208862 | A1* | 7/2017 | Li | H01M 10/0525 |
| 2017/0208865 | A1* | 7/2017 | Nettenstrom | A24F 40/95 |
| 2019/0230985 | A1 | 8/2019 | Chan et al. | |
| 2019/0273383 | A1 | 9/2019 | He | |

FOREIGN PATENT DOCUMENTS

| | | | |
|---|---|---|---|
| CN | 110279154 | A | 9/2019 |
| JP | 2017-535245 | A | 11/2017 |
| JP | 2019-505201 | A | 2/2019 |
| JP | 2019-524091 | A | 9/2019 |
| KR | 10-2010-0135142 | A | 12/2010 |
| RU | 76 781 | U1 | 10/2008 |
| WO | WO 2015/003394 | A1 | 1/2015 |
| WO | WO 2016/079729 | A1 | 5/2016 |
| WO | WO 2018/202730 | A1 | 11/2018 |
| WO | WO 2019/037880 | A1 | 2/2019 |
| WO | WO 2019/037881 | A1 | 2/2019 |
| WO | WO 2019/037882 | A1 | 2/2019 |
| WO | WO 2019/037883 | A1 | 2/2019 |

OTHER PUBLICATIONS

Combined Russian Office Action and Search Report issued Feb. 2, 2024, in corresponding Russian Patent Application No. 2022112859/03(026726) (with English Translation), 21 pages.

International Search Report issued Mar. 3, 2021 in PCT/EP2020/079272 filed on Oct. 16, 2020, 5 pages.

Written Opinion issued Mar. 3, 2021 in PCT/EP2020/079272 filed on Oct. 16, 2020, 7 pages.

Extended European Search Report issued Apr. 7, 2020, in corresponding European Patent Application No. 19203865.1, 7 pages.

Written Opinion issued Aug. 25, 2021, in PCT/EP2020/079272, 4 pages.

International Preliminary Report on Patentability issued Jan. 21, 2022, in PCT/EP2020/079272, 12 pages.

Office Action issued Sep. 19, 2024, in corresponding Japanese Patent Application No. 2022-522286 (with English Translation), 4 pages.

Office Action and Search Report mailed Apr. 1, 2025, in Chinese Patent Application No. 2020800725524.5, 22 pages (with English language translation).

* cited by examiner

SMOKING DEVICE WITH MAIN UNIT HAVING A RESILIENT LATCHING MEMBER

BACKGROUND

The invention relates to a holder for an aerosol-generating device. Specifically, the invention relates to a holder for an aerosol-generating device, the holder comprising a retainer.

Aerosol-generating systems generally comprise an aerosol-forming substrate and an atomiser which is operable to atomise volatile compounds in the aerosol-forming substrate to form an aerosol for inhalation by a user. Typically, aerosol-generating systems also comprise an aerosol-generating device comprising an electrical power supply for supplying power to the atomiser. The atomiser may be an electrically operated heating means, for example an electric heater.

In some systems, an aerosol-generating device is configured to receive an aerosol-generating article comprising a solid aerosol-forming substrate, for example a substrate comprising homogenised tobacco. In these systems, the device typically comprises the atomiser, which is arranged to heat the aerosol-forming substrate when the article is received in the device. The article may also comprise a filter, which is wrapped together with the aerosol-forming substrate in the form of a rod, similar to a conventional cigarette. In some systems an aerosol-generating article may comprise a cartridge containing a liquid or gel aerosol-forming substrate that can be heated by an atomiser. In some systems, a device may be configured to receive a cartridge that comprises both the atomiser and a liquid aerosol-forming substrate. Such cartridges are often referred to as cartomisers. A common configuration of atomiser used in a cartomiser comprises a coil of heater wire wound around an elongate wick soaked in liquid aerosol-forming substrate.

Some electrically operated aerosol-generating systems comprise a separate holder for releasably holding the aerosol-generating device when not in use. Such holders may also function as a case or holder and may provide a degree of protection for the aerosol-generating device. A holder may also provide additional functions such as data-logging and refilling of the aerosol-generating device with aerosol-forming substrate.

Aerosol-generating devices typically have a high aspect ratio, having a first, longitudinal, dimension that is greater in magnitude than second and third, width, dimensions. Holders for aerosol-generating devices often comprise housings defining narrow openings into which a user is required to insert the device. The narrow openings typically have a width similar to the width of the aerosol-generating device. Users inserting an aerosol-generating device into these cases are generally required to closely align the aerosol-generating device with the narrow opening to insert the aerosol-generating device into the holder, and then slide the aerosol-generating device longitudinally into the holder. This can be difficult for users, especially in low light or when the user is moving.

Further, some holders for aerosol-generating devices comprise a latching mechanism to engage with an aerosol-generating device held by the holder. For example, WO2019037881A1 describes a latching mechanism comprising an actuatable latching member mounted on a spring element within a latch cavity. The spring element is biased to withdraw the latching member within the cavity. A sliding button is manually operable from a first position to a second position to engage with the spring element and urge the latching member through an opening to latch with an aerosol-generating device. Movement of the sliding button from the second position back to the first position allows the latching member to be withdrawn back into the latching cavity.

BRIEF SUMMARY

It would be desirable to provide a holder which can securely hold an aerosol-generating device. It would also be desirable to provide a holder which can securely hold an aerosol-generating device without requiring a separate user action to secure the device in the holder. It would also be desirable to provide a holder which a user can operate with one hand.

As used herein and below, the term "aerosol-generating device" refers to a device that interacts with an aerosol-forming substrate to generate an aerosol. An aerosol-generating device may interact with an aerosol-generating article comprising an aerosol-forming substrate, or with a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein and below, the term "aerosol-forming substrate" refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components.

As used herein and below, the term "aerosol-generating article" refers to an article comprising an aerosol-forming substrate. In some examples, the aerosol-generating article may comprise an aerosol-forming substrate capable of releasing volatile compounds upon heating, and these volatile compounds may form an aerosol.

As used herein and below, the term "aerosol" refers to a dispersion of solid particles or liquid droplets or a combination of solid particles and liquid droplets in a gas. The aerosol may be visible or invisible. The aerosol may include vapours of substances that are ordinarily liquid or solid at room temperature as well as solid particles or liquid droplets or a combination of solid particles and liquid droplets.

As used herein and below, with reference to an aerosol-generating device (or article), the term "longitudinal" is used to describe a direction between a downstream, proximal or mouth end of the device (or article) and an opposed, upstream or distal end of the device (or article).

As used herein and below, with reference to an aerosol-generating device or article, the term "transverse" is used to describe a direction perpendicular to the longitudinal direction.

As used herein and below, with reference to an aerosol-generating device (or article), the term "length" is used to describe a maximum longitudinal dimension between the distal or upstream end of the device (or article) and the proximal or downstream end of the device (or article).

As used herein and below, the term "diameter" is used to describe the maximum transverse dimension of components, for example aerosol-generating devices and aerosol-generating articles.

As used herein and below, the term "exposed" is used to indicate that a portion of a feature or component is open to the external environment and not enclosed or covered.

According to the present disclosure, there is provided a holder for an aerosol-generating device. The holder may have a docking arrangement. The docking arrangement may be configured to engage with the aerosol-generating device. The docking arrangement may comprise a docking space. The docking space may be defined between a first end and an opposing second end. The second end may be spaced from and fixed relative to the first end. The docking space may be suitable for accommodating, or configured to accommodate, a longitudinal dimension of the aerosol-generating device. The holder may comprise a retainer. The retainer may be suitable for engagement with an end of the aerosol-generating device to releasably retain the aerosol-generating device in the docking space. The retainer may have a first surface fixed relative to the first end. The retainer may have a second surface projecting away from the first end. The second surface may project into the docking space. The second surface may be deflectable relative to the first end on engagement with the end of the aerosol-generating device.

According to one example, there is provided a holder for an aerosol-generating device. The holder has a docking arrangement configured to engage with the aerosol-generating device, the docking arrangement comprising a docking space defined between a first end and an opposing second end spaced from and fixed relative to the first end. The docking space is suitable for accommodating, or is configured to accommodate, a longitudinal dimension of the aerosol-generating device. The holder comprises a retainer for engagement with an end of the aerosol-generating device to releasably retain the aerosol-generating device in the docking space. The retainer has a first surface fixed relative to the first end, and a second surface projecting away from the first end into the docking space, the second surface being deflectable relative to the first end on engagement with the end of the aerosol-generating device.

Advantageously, the holder may allow a user to quickly and easily insert an aerosol-generating device into, and retrieve an aerosol-generating device from, the holder. Further, the user may be able to securely locate the device in the holder with one hand, and in one action. Advantageously, the retainer is deflectable relative to the first end on engagement with the end of the aerosol-generating device. This may allow the holder to securely hold a device without the need for a user to press a button or otherwise actuate another retaining means.

The retainer may comprise a resiliently deflectable or deformable elastic or elastomeric material. The retainer may comprise a non-metallic material. The retainer may be entirely non-metallic. The retainer may comprise a polymer, such as a resiliently deflectable or deformable polymer. For example, the retainer may be formed from, or comprise a resilient polymer, for example a natural rubber or a synthetic rubber, for example a nitrile, or a silicone, or a butadiene, or a butyl polymer. The retainer may comprise a foam or foam-like material, such as a resiliently deflectable or deformable foam or foam-like material. A foam or foam like material may be formed from, or comprise a resilient polymer, for example a natural rubber or a synthetic rubber, for example a nitrile, or a silicone, or a butadiene, or a butyl polymer. It may be particularly preferable that the retainer comprises, or is formed from, a nitrile such as a nitrile rubber. For example, it may be particularly preferable that the first surface of the retainer, or the second surface of the retainer, or both the first surface and the second surface of the retainer, comprise, or are formed from, a nitrile such as a nitrile rubber.

Advantageously, this may allow the retainer to deflect, or deform, upon contact with an aerosol-generating device in order to allow the device to be accommodated in the docking space. This resilient deflection, or deformation, may also advantageously act to exert a force on a device accommodated in the holder. Advantageously, this force may allow the holder to securely retain the device in the docking space of the holder.

The retainer may be formed from a resiliently deformable elastic or elastomeric material. The first surface of the retainer may be a first surface of the resiliently deformable elastic or elastomeric material. The second surface of the retainer may be a second surface of the resiliently deformable elastic or elastomeric material.

Advantageously, resilient deformation of the resiliently deformable elastic or elastomeric material may allow the second surface of the retainer to be deflectable relative to the first end.

The second surface of the retainer may be configured to elastically deform in response to a force, for example a force from an end of an aerosol-generating device engaging with the retainer.

A force may be applied to the retainer as a user attempts to accommodate the device in the holder. This may occur as an end of an aerosol-generating device engages with the retainer. In response to such a force, the second surface, or a point on the second surface, may be configured to deflect by at least 1 or 2 mm relative to the first end of the holder, or relative to the first surface of the retainer.

The retainer may be configured to apply a force to an aerosol-generating device retained in the docking space. The force may act to urge the aerosol-generating device away from the first end and towards the second end.

Advantageously, this may allow the holder to securely retain the device in the docking space of the holder.

The retainer may be configured to engage with an opening or recess defined at the end of the aerosol-generating device. The opening or recess may be bounded by a rim or lip, and the retainer engages with the rim or lip.

Advantageously, this may reduce an amount of dust or debris from entering the opening or recess of the device.

The rim or lip may be a continuous rim or lip bounding the opening or recess. When the aerosol-generating device is retained in the docking space, a seal may be formed by interaction between the second surface of the retainer and the rim or lip. This may seal the opening or recess. The second surface of the retainer may form a continuous, circumferential ring of contact with the continuous rim or lip bounding the opening or recess. This may seal the opening or recess.

Advantageously, the seal may reduce an amount of dust or debris from entering the opening or recess of the device. This may be particularly important for devices having a heater element located in a chamber accessible through the opening or recess. The seal may reduce an amount of dust or debris from entering the opening or recess of the device substantially to zero. The seal may prevent dust or debris from entering the opening or recess of the device.

The second surface of the retainer may be substantially hemispherical in shape. A portion of the substantially hemispherical shape may be located in the opening or recess of the device when the device is accommodated in the docking space.

Advantageously, a substantially hemispherical shape may allow sufficient deflection, or deformation, to allow a user to insert the device into the docking space. This shape may also be suited to securely retaining the device in the docking space if this shape matches the shape of the opening or recess of the device.

The aerosol-generating device may be an elongate aerosol-generating device. The elongate device may define a longitudinal dimension. The docking space may be configured to accommodate the longitudinal dimension of the elongate aerosol-generating device.

Accommodation or retention of the aerosol-generating device in the docking space may be effected by relative movement of the aerosol-generating device and the docking space in a direction perpendicular to the longitudinal dimension of the aerosol-generating device.

Advantageously, by using substantially perpendicular movement, less distance needs to be travelled to accommodate the aerosol-generating device in the docking space than in a holder that accommodates the aerosol-generating device when the device is inserted in a longitudinal direction into a docking space.

Relative movement of the aerosol-generating device and the docking space in the direction perpendicular to the longitudinal dimension of the aerosol-generating device may cause elastic deformation or deflection of the retainer. The retainer may act to resume its undeformed shape. This may be due to the resilience of the retainer. This may exert a force on the device accommodated in the docking space.

Advantageously, this may allow the holder to securely retain the device in the docking space of the holder.

The retainer may be in a first state, for example an undeformed first state, when the aerosol-generating device is not retained in the docking space. The retainer may be in a second state, for example a deformed second state, when the aerosol-generating device is retained in the docking space. The retainer may act to resume its undeformed shape. This may be due to the resilience of the retainer. This may exert a force on the device accommodated in the docking space. The retainer may exert urge a device accommodated in the docking space away from the first end, or towards the second end, or both away from the first end and towards the second end.

Advantageously, this may allow the holder to securely retain the device in the docking space of the holder.

The retainer may be in a first state, for example an undeformed first state, when the aerosol-generating device is not retained in the docking space. The retainer may be deformed, or deflected, as the device is inserted in the docking space. The retainer may then resume its first state in the opening or recess of the device.

The second end of the docking space, or a component located at or towards the second end of the docking space, may be configured to engage with the aerosol-generating device. This engagement may be for releasably retaining the device in the docking space. For example, the second end of the docking space, or a component located at or towards the second end of the docking space, may be configured to engage with an end of the aerosol-generating device opposite to the end configured to engage with the retainer. Thus, the retainer and the second end of the docking space or a component located at or towards the second end of the docking space may be configured to engage with the aerosol-generating device. For example, the retainer may be configured to engage a first end of the device and the second end of the docking space or a component located at or towards the second end of the docking space may be configured to engage with a second end of the device. Where the device is an elongate device, the length of the device may span between the first end and the second end of the device.

The holder may comprise a power source. The second end of the holder may comprise an electrical contact electrically connected to the power source. The aerosol-generating device may comprise a corresponding electrical contact, for example at an end of the device, such as at the end opposite to the end having the opening or recess. The electrical contact may be configured to engage with the corresponding electrical contact of the aerosol-generating device so as to supply power from the power source to the aerosol-generating device when the aerosol-generating device is retained in the docking space.

Advantageously, this may allow the holder to charge, or recharge, a device accommodated in the docking space.

When the aerosol-generating device is retained in the docking space, the retainer may urge the aerosol-generating device towards the electrical contact of the holder. For example, when the retainer is in a deformed or deflected shape, the retainer may act so as to resume an undeformed or undeflected shape. This may cause a force to act on the device. This may be due to the resilience of the retainer. This force may urge the device away from the first end of the holder. This force may urge the device towards the second end of the holder.

Advantageously, this may provide a secure electrical connection between the electrical contact of the holder and the corresponding electrical contact of the aerosol-generating device.

The aerosol-generating device may comprise a body extending between a proximal end and a distal end. When the aerosol-generating device is accommodated in the docking space, a first side portion of the body may face the holder. When the aerosol-generating device is accommodated in the docking space, a second side portion of the body may face away from the holder. When the aerosol-generating device is accommodated in the docking space, the second face may be exposed.

The retainer may be configured to engage with an end of the aerosol-generating device to releasably retain the aerosol-generating device in the docking space regardless of the relative orientation of the end of the device. For example, the retainer may be substantially hemispherical in shape, and the device may comprise a substantially circular opening or recess at its proximal end. Thus, regardless of the orientation of the proximal end of the aerosol-generating device, the proximal end of the device may be configured to engage with the retainer.

Optionally, the holder comprises a housing for retaining the primary power source. The primary power source may be, for example, a rechargeable battery retained by or within a housing of the holder. Optionally, engagement between the holder and the aerosol-generating device when the aerosol-generating device is accommodated by the docking space allows the secondary power source of the aerosol-generating device to be charged by the primary power source of the holder. For example, electrical contacts located on the aerosol-generating device may be arranged to engage with corresponding electrical contacts located on the holder when the aerosol-generating device has been engaged with the docking arrangement.

The aerosol-generating device may be configured to generate an inhalable aerosol from an aerosol-forming substrate. The aerosol-generating device may be elongate and substantially shaped like a cigarette or cigar. For example, the elongate aerosol-generating device may have a first, longitudinal or length, dimension that is greater in magnitude than second and third, width, dimensions. The second and third dimensions may be denoted as width and thickness, although the second and third dimensions are optionally substantially the same and may, therefore, both be referred to as width. The elongate aerosol-generating device may be substantially cylindrical. The longitudinal dimension defines a longitudinal axis. Width dimensions extend perpendicular to the longitudinal axis. The elongate aerosol-generating device may be described as having a proximal end and a distal end, with an elongate body defined between the proximal end and the distal end. The body may comprise at least one side surface extending between the proximal end and the distal end.

The docking space may be further defined by a rear portion extending between the first end and the second end. Thus, the docking space may be at least partially defined by the first end, the second end, and a rear portion. The rear portion may be a rear wall. The rear portion may be part of a housing of the holder. The rear portion may be part of an external wall of a housing of the holder.

The aerosol-generating device may be easily engaged and disengaged with the docking arrangement by movement into the docking space in a direction perpendicular to a longitudinal axis of the aerosol-generating device, that is movement in a transverse direction relative to the aerosol-generating device. The aerosol-generating device may be easily engaged and disengaged with the docking arrangement by movement into the docking space in a direction substantially perpendicular to a longitudinal axis of the aerosol-generating device. For example, either a proximal end or a distal end of the aerosol-generating device may be inserted into engagement with the holder in the docking space. The opposite end may then be pivoted into the docking space such that the aerosol-generating device is fully engaged with the holder. For example, a distal end of the aerosol-generating device may be inserted into engagement with the holder in the docking space. Then, the proximal end may be pivoted into the docking space such that the aerosol-generating device is fully engaged with the holder. This pivoting motion may cause deflection, or deformation, of the retainer. For example, this pivoting motion may cause an end of the device to cause deflection, or deformation, of the second surface of the retainer relative to the first end of the holder. Once the device has been pivoted by a sufficient amount, a proportion of the retainer may be located in an opening or recess located at the proximal end of the device. A portion of the retainer may also not be located in the opening or recess. For example, a portion could be located above the opening or recess, or adjacent the opening or recess. When the device is accommodated in the docking space, the retainer may engage with the proximal end of the device to releasably retain the device in the docking space.

By using perpendicular, or substantially perpendicular, movement, less distance needs to be travelled to engage the aerosol-generating device and the holder than would be the case in a typical system that accepts the aerosol-generating device when inserted in a longitudinal direction into a holder. The docking space of the holder accommodates the longitudinal dimension of the aerosol-generating device. The docking space may accommodate the longitudinal dimension of the aerosol-generating device. Thus, it may be easier to locate the aerosol-generating device in the docking space than would be the case if the docking space was dimensioned to accommodate only transverse dimensions of the aerosol-generating device.

The docking space may at least partially form an open groove in a housing of the holder. Thus, the docking space may be, at least partially, defined by a first side wall, a second side wall, a rear wall, and the first and second ends. The open groove may be an elongated depression or slot defined by a housing of the holder. The elongated aerosol-generating device may be entirely accepted within the open groove such that no portion of the aerosol-generating device extends beyond a peripheral boundary of the holder. Alternatively, the elongated aerosol-generating device may be only partially accepted within the open groove. In this case, a portion of the aerosol-generating device, which may be termed an exposed portion, extends beyond a peripheral boundary of the holder.

It may be advantageous that a portion of the aerosol-generating device is exposed when the aerosol-generating device is engaged with the holder. For example, it may be advantageous that at least one side surface of a body of the aerosol-generating device forms an external surface of the system when the aerosol-generating device is engaged with the holder. The aerosol-generating device may be easily retrieved by a user, who would then merely need to grip the exposed portion of the aerosol-generating device and disengage the aerosol-generating device from the holder. This disengagement may deform or deflect at least a portion of the retainer. For example, this disengagement may cause the second surface of the retainer to deflect or deform relative to the first end of the holder as the end of the aerosol-generating device disengages from the retainer. The exposed portion of the aerosol-generating device may be shaped to conform or correspond to a shape of a housing of the holder. The holder may have a housing that is shaped or contoured, and the aerosol-generating also have a housing or external surface that is configured to conform to the shape or contour of the holder housing when the aerosol-generating device is engaged with the holder. The aerosol-generating device may act to close or cover an open groove in the holder. Thus, holder features such as displays, indicators, contacts, or buttons located in such an open groove may be shielded from the external environment when an aerosol-generating device is engaged with the holder. In this way, displays, indicators, contacts, or buttons may be protected when the aerosol-generating device is engaged with the holder, for example during transit.

In some examples the first end and the second end are located on projections extending from a housing of the holder, for example first and second projections extending from the housing. The projections may be termed lugs. Thus, a longitudinal dimension of the docking space may be defined between opposing first and second ends located on the first and second projections. The docking space may not be constrained in any other dimension. An aerosol-generating device engaged with such a docking space would only have contact with the first and second ends and would, when engaged, extend longitudinally between the projections. Alternatively, the docking space may be further constrained by a rear wall extending between the first and second projections. The docking space may be still further constrained by one or more side walls extending between the first and second projections.

The docking space is optionally configured to receive the aerosol-generating device when the aerosol-generating device is urged, or moved, into the docking space in a direction substantially perpendicular to the longitudinal dimension of the aerosol-generating device. Thus, when engaged with the holder, the longitudinal dimension of the aerosol-generating device may be parallel to a side or an edge of the holder.

The aerosol-generating device may comprise charging contacts located at, or near, a distal end or at, or near, a proximal end, and the holder may comprise corresponding charging contacts located on, or near, the first end of the docking arrangement or on, or near, the second end of the docking arrangement. It may be advantageous if at least one charging contact is configured as a concentric ring in an end face of the aerosol-generating device, for example in a distal end face of the aerosol-generating device. Thus, a distal end face of the aerosol-generating device may comprise first and second concentric electrical contacts arranged concentrically, for example as concentric rings, the first electrical contact being a positive contact and the second electrical contact being a negative contact. One contact may be a point contact and the other contact may be a ring surrounding the point contact. Corresponding contacts, which may or may not be in the form of concentric rings, may be defined on the first end or the second end of the holder to allow for electrical coupling between the aerosol-generating device and the holder. The first end or the second end of the holder may comprise first and second concentric electrical contacts arranged as concentric rings, the first electrical contact being a positive contact and the second electrical contact being a negative contact. Corresponding contacts, which may or may not be in the form of concentric rings, may then be defined on the distal end or the proximal end of the aerosol-generating device to allow for electrical coupling between the aerosol-generating device and the holder. The use of contacts in the form of a ring, or rings, allows the aerosol-generating device to be oriented in any radial direction when engaged with the holder. That is, because at least one portion of a contact set is in the form of a ring, the corresponding contact can be positioned such that contact is always made, whatever the radial orientation that the aerosol-generating device is in when presented to the docking arrangement of the holder. This may further simplify the engagement and disengagement of the respective devices, as a user does not need to be concerned with radial orientation of the aerosol-generating device.

Alternatively, charging contacts may be configured as circumferential rings substantially or entirely encircling one or more body portions of the aerosol-generating device, for example a circumference near the distal end of the aerosol-generating device. Thus, body of the aerosol-generating device may comprise first and second longitudinally spaced circumferential electrical contacts, the first electrical contact being a positive contact and the second electrical contact being a negative contact. Corresponding contacts may be defined on the holder to allow for electrical coupling between the aerosol-generating device and the holder.

Charging contacts may be arranged symmetrically on the body of the aerosol-generating device. For example, a first charging contact may be located at a midpoint of the body of the aerosol-generating device between the proximal end and the distal end. Further contacts may be spaced equidistant distally and proximally such that one of them aligns with a corresponding contact on the holder whatever the longitudinal orientation that the aerosol-generating device is engaged with the holder. Likewise, charging contacts may be arranged symmetrically on the body of the aerosol-generating device such that one of them aligns with a corresponding contact on the aerosol-generating device whatever the longitudinal orientation that the aerosol-generating device is engaged with the holder.

Charging contacts may allow for data transfer between the aerosol-generating device and the holder as well as allowing for the charging of the secondary power source. Alternatively, one or more dedicated data transfer contacts may be defined on the aerosol-generating device and the holder to allow for data transfer between the devices.

Optionally, at least a portion of the aerosol-generating device remains exposed when the aerosol-generating device is engaged with the holder. For example, at least one side wall of the aerosol-generating device, for example at least one external side wall, may remain exposed to the external environment when the aerosol-generating device is engaged with the holder. The at least one external side wall optionally does not include any user actuatable buttons, displays, and contacts. A user may be more easily able to take hold of the exposed surface of the at least one external side wall to facilitate disengagement of the aerosol-generating device from the holder. A user may be able to grip the exposed surface and apply pressure to disengage the aerosol-generating device from the holder, for example by disengaging an end of the device from the retainer of the holder. The aerosol-generating device may, therefore, be easy to retrieve from engagement with the holder.

The holder may have a length between about 50 mm and about 200 mm. The holder may have an external diameter, or maximum transverse cross-section, of between about 10 mm and about 50 mm.

The holder may have a transverse cross-section of any suitable shape. For example, the holder may have a substantially circular, elliptical, triangular, square, rhomboidal, trapezoidal, pentagonal, hexagonal or octagonal transverse cross-section. The holder may have a substantially constant transverse cross-section along its length. The holder may have a substantially rectangular transverse cross-section along its length. In some examples, the holder may be a substantially rectangular cuboid.

The housing of the holder may be a substantially rectangular cuboid. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. In some examples, the material is light and non-brittle.

The aerosol-generating device may be a hand-held device. In other words, the aerosol-generating device may have any size and shape suitable to be held in the hand of a user. The aerosol-generating device may have a size and shape similar to a conventional cigarette or cigar. The aerosol-generating device may be portable.

The aerosol-generating device may have a transverse cross-section of any suitable shape. For example, the aerosol-generating device may have a substantially circular, elliptical, triangular, square, rhomboidal, trapezoidal, pentagonal, hexagonal or octagonal transverse cross-section. In some examples, the aerosol-generating device has a substantially circular transverse cross-section.

The aerosol-generating device may have a substantially constant transverse cross-section along its length. The aerosol-generating device may have a substantially circular transverse cross-section along its length. The device may have rotational symmetry about its longitudinal axis. The device may have rotational symmetry of an order greater than one about its longitudinal axis. The device may be substantially axisymmetric about its longitudinal axis. In some examples, the aerosol-generating device may be substantially circularly cylindrical. The aerosol-generating device may have any suitable diameter (maximum transverse cross-section) and any suitable length. The aerosol-generating device may be elongate. In some examples, the aerosol-generating device may have a shape, diameter and length substantially similar to a conventional cigarette or cigar. The aerosol-generating device may have a length between about 30 mm and about 150 mm. The aerosol-generating device may have an external diameter between about 5 mm and about 30 mm.

The aerosol-generating device may be configured to receive one or more of a cartridge, an atomiser and an aerosol-generating article. The aerosol-generating device may be configured to receive one or more of a cartridge, an atomiser and an aerosol-generating article at a proximal end. The device may comprise a cavity for receiving one or more of a cartridge, an atomiser and an aerosol-generating article.

In some examples, the aerosol-generating device may comprise an atomiser. Where the aerosol-generating device comprises an atomiser, the device may be configured to receive an article comprising an aerosol-forming substrate or a cartridge comprising an aerosol-forming substrate. In other examples, the aerosol-generating device may be configured to receive an atomiser or a combination of an atomiser and an article or a cartridge comprising an aerosol-forming substrate. Where the device comprises a cavity for receiving one or more of a cartridge and an aerosol-generating article, the atomizer may be arranged in the cavity.

The aerosol-generating device may comprise a housing. In some examples, the housing may be substantially circularly cylindrical. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. In some examples, the material is light and non-brittle.

The primary power source and the secondary power source may comprise any suitable types of electrical power supplies. For example, the primary power source and the secondary power source may comprise one or more of batteries and capacitors. The primary power source and the secondary power source may comprise lithium ion batteries. The primary power source and the secondary power source may be rechargeable electrical power supplies. The primary power source and the secondary power source may be identical. The primary power source and the secondary power source may be different. The primary power source may have a larger size than the secondary power source of the aerosol-generating device.

According to a second example, there may be provided a system. The system may comprise a holder, for example a holder as described herein. The system may also comprise an aerosol-generating device, for example an aerosol-generating device as described herein. The system may also comprise an aerosol-generating article, for example an aerosol-generating article as described herein.

Any features described in relation to the holder according to the first example may be applicable to the holder of the system according to the second example. Any features described in relation to an aerosol-generating device, for example an aerosol-generating device for engagement with the holder, may be applicable to the aerosol-generating device of the system according to the second example.

BRIEF DESCRIPTION OF THE DRAWINGS

The invention will be further described, by way of example only, with reference to the accompanying drawings, in which.

DETAILED DESCRIPTION

Figure 1:
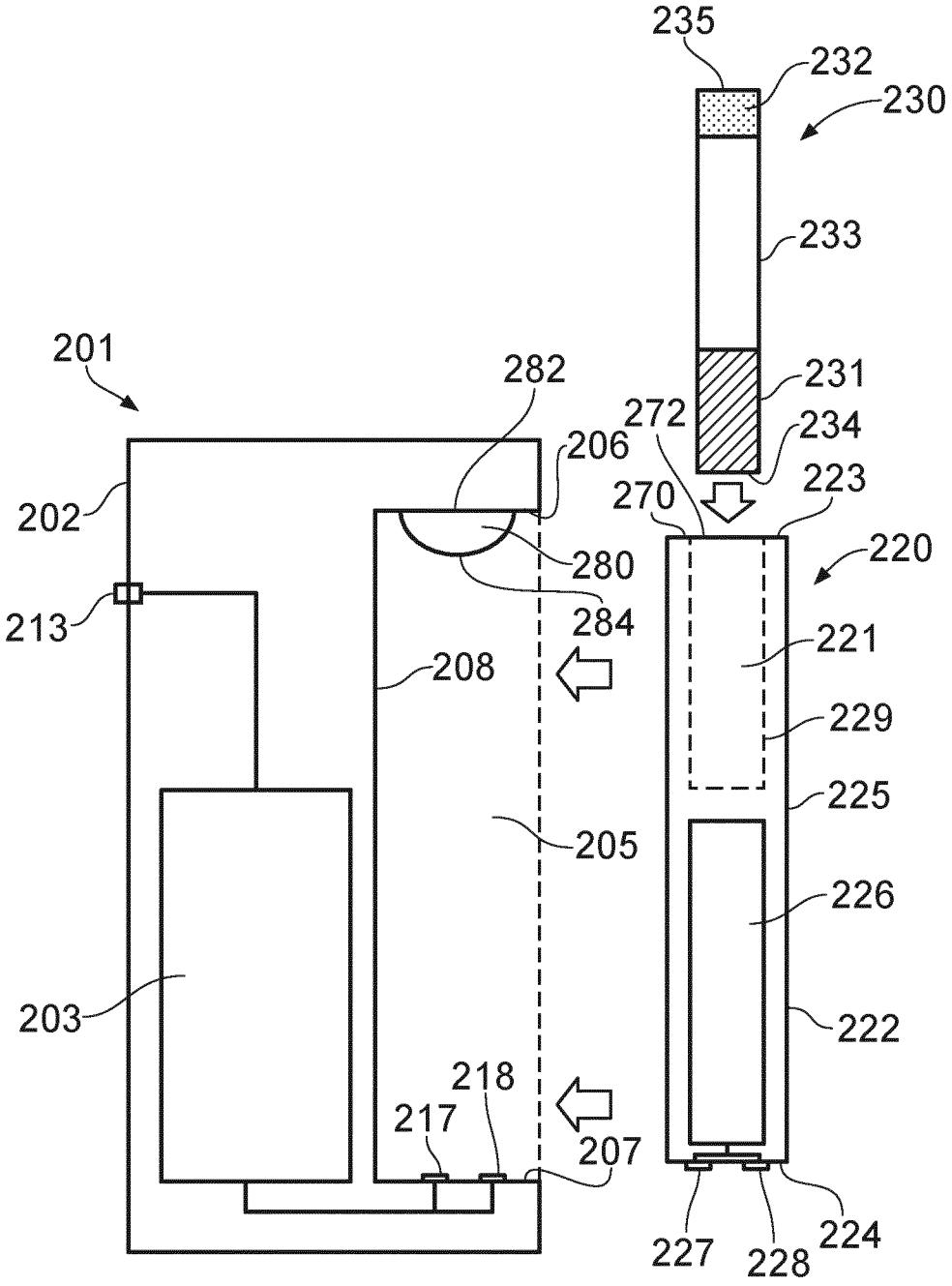
FIG. 1 is a schematic illustration an aerosol-generating device, an aerosol-generating article, and a holder.

FIG. 1 is a schematic illustration an aerosol-generating device 220, an aerosol-generating article 230, and a holder 201.

The holder 201 has a docking arrangement configured to engage with the aerosol-generating device 220. The docking arrangement comprises a docking space 205 defined between a first end 206 and an opposing second end 207 spaced from and fixed relative to the first end 206. The docking space 205 is suitable for accommodating a longitudinal dimension of the aerosol-generating device 220. The holder comprises a retainer 280 for engagement with an end of the aerosol-generating device 220 to releasably retain the aerosol-generating device 220 in the docking space 205. The retainer has a first surface 282 fixed relative to the first end 206, and a second surface 284 projecting away from the first end 206 into the docking space 205, the second surface 284 being deflectable relative to the first end 206 on engagement with the end of the aerosol-generating device 220.

The holder 201 comprises a housing 202 that is approximately the same size and shape as a conventional packet of cigarettes. The housing 202 locates and retains a Li-ion battery 203. This battery 203 may be termed a primary power source or primary battery of the system. The primary battery 203 is electrically connected to a charging port 213 to allow the primary battery 203 to be recharged from an external power supply such as mains power.

The docking space is further defined by a rear wall 208 and first and second side walls to form an elongate docking space 205 having a longitudinal axis extending between the first end 206 and the second end 207. The first end 206, second end 207, rear wall 208 and first and second side walls are portions of the housing 202. The docking space 205 is not closed by a cover or lid and forms an open groove in the housing 202 of the holder 201. First and second electrical contacts 217, 218 are located by the second end 207 and face into the docking space 205. The first and second electrical contacts are electrically connected to the primary battery 203. The holder 201 further comprises electric circuitry such as at least one microprocessor to control the charging and the discharge of the primary battery 203.

The aerosol-generating device has an elongated housing 222 that is substantially cylindrical having a proximal end 223, a distal end 224, and a body 225 extending between the proximal end 223 and the distal end 224.

The length of the device 220 is substantially the same as the length of the longitudinal dimension of the docking space 205. First and second device contacts 227, 228 are located by the distal end 224 and face away from the distal end. The first and second device contacts are electrically connected to a device battery 226 to allow for recharging of the device battery 226. The device battery 226, which may be termed a secondary power source or secondary battery, may be any suitable battery, for example a Li-ion battery or a lithium iron phosphate battery.

A substrate-receiving cavity 221 is defined in a proximal portion of the device 220 for receiving an aerosol generating article comprising an aerosol-forming substrate. The cavity 221 is substantially cylindrical and has an opening 272 defined in the proximal end of the device. The opening 272 is bounded by a rim 270. Heating elements positioned around internal walls 229 of the substrate receiving cavity 221 are electrically connected to the device battery 226 and act to heat the cavity. In alternate examples the heating elements may be defined on a heating member such as a pin or a blade that is located within the cavity for insertion into an aerosol-generating article. In other examples, induction coils may be located around the walls 229 of the cavity 221 to inductively heat a susceptor within the cavity 221 or within an aerosol-generating article inserted into the cavity.

Electronics, including a microprocessor, are included in the aerosol-generating device for controlling charging of the device battery 226 and operation of the heating means.

The aerosol-generating article 230 is a cylindrical article comprising a plurality of components, including an aerosol-forming substrate 231 and a mouthpiece filter 232, assembled within a cigarette paper 233. The article 230 has a distal end 234 and a proximal end 235 or mouth end located downstream of the distal end 234. The aerosol-forming substrate 231 is optionally in the form of a gathered sheet of homogenised tobacco material and is located at or near to the distal end 234 of the article 230. Further components such as aerosol-cooling elements, flavouring elements and spacing elements may be positioned between the aerosol-forming substrate 231 and the mouthpiece filter 232 within the article 230.

The aerosol-generating device 220 has a longitudinal dimension that is approximately the same length as the longitudinal dimension of the docking space 205. The aerosol-generating device 220 may be engaged with the holder 210 by aligning the longitudinal axis of the aerosol-generating device 220 with the longitudinal axis of the docking space 205, with the proximal end 223 of the aerosol-generating device 220 adjacent the first end 206 of the docking arrangement and the distal end 224 of the aerosol-generating device 220 adjacent the second end 207 of the docking arrangement. The aerosol-generating device may then be moved into engagement by a translational movement, that is a movement perpendicular to the longitudinal axis of the aerosol-generating device 220, into the docking space 205. The proximal end 223 of the aerosol-generating device 220 engages with the first end 206 and the distal end of the aerosol-generating device 224 engages with the second end 207. The first and second contacts 217, 218 align with, and make electrical contact with, the first and second device contacts 227, 228. The aerosol-generating device may be held in engagement by an interference, or frictional, engagement. Alternatively, mechanical latching means may be automatically or manually operated to retain the aerosol-generating device in engagement with the holder. In other examples, magnetic latching means may be used to retain the aerosol-generating device in engagement with the holder.

When engaged with the holder 210, a portion of the body 225 of the aerosol-generating device 220 remains exposed to the external environment. In some examples the docking space is not enclosed and the majority of the body 225 of the aerosol-generating device 220 is exposed when the aerosol-generating device 220 is engaged with the holder 201.

Charging of the device battery may be effected automatically on engagement between the aerosol-generating device 220 and the holder 201. Alternatively, charging may require manual actuation, for example by operating a button.

The aerosol-generating device 220 may be removed from engagement with the holder 201 by holding an exposed portion of the aerosol-generating device and moving the aerosol-generating device out of the docking space with a transverse movement. In some examples a mechanical latch may need to be released. In some examples, an extraction tool or extraction means may engage with the aerosol-generating device to push the aerosol-generating device out of the docking space. An extraction tool may simply be a member that pushes the aerosol-generating device 220 transversely out of the docking space 205.

Once the device battery 226 has been charged, the aerosol-generating device may be used for consumption of a consumable aerosol-generating article. The aerosol-generating device is removed from engagement with the holder and the aerosol-generating article is inserted into the substrate receiving cavity 221. The heater of the device 220 is actuated and the aerosol-forming substrate 231 if the article 230 is heated to a temperature sufficient to generating an inhalable aerosol. By drawing on the proximal end 235 of the article 230, a user is able to inhale the aerosol into their mouth and lungs. Once the article has been consumed, it can be removed from the device 220, and the aerosol-generating device 220 can be returned to engagement with the holder 201 for recharging of the device battery 226.

In some examples, data may be transferred between the aerosol-generating device and the holder. The data may be transferred using the same contacts that are used for charging 217, 218, 227, 228. Alternatively, separate data contacts may be provided. Data transfer between the holder 201 and the aerosol-generating device 220 may be achieved wirelessly, for example by Bluetooth connection.

In some examples, the first and second charging contacts 217, 218 may be in the form of concentric rings. The device charging contacts 227, 228 may be corresponding concentric rings, or may be point contacts configured to align with the respective concentric rings. The advantage of this configuration is that the aerosol-generating device may be engaged with the holder in any radial orientation.

The retainer 280 is formed from a resiliently deformable elastomeric material. Specifically, the retainer 280 in this example is formed of a resiliently deformable synthetic rubber such as a nitrile. The retainer may be formed from any suitable resilient material, for example natural rubber. In FIG. 1, the retainer 280 is shown in an undeformed, or undeflected, state. As can be seen in FIG. 1, the retainer 280, in its undeformed, or undeflected, state, is substantially hemispherical in shape.

Figure 2:
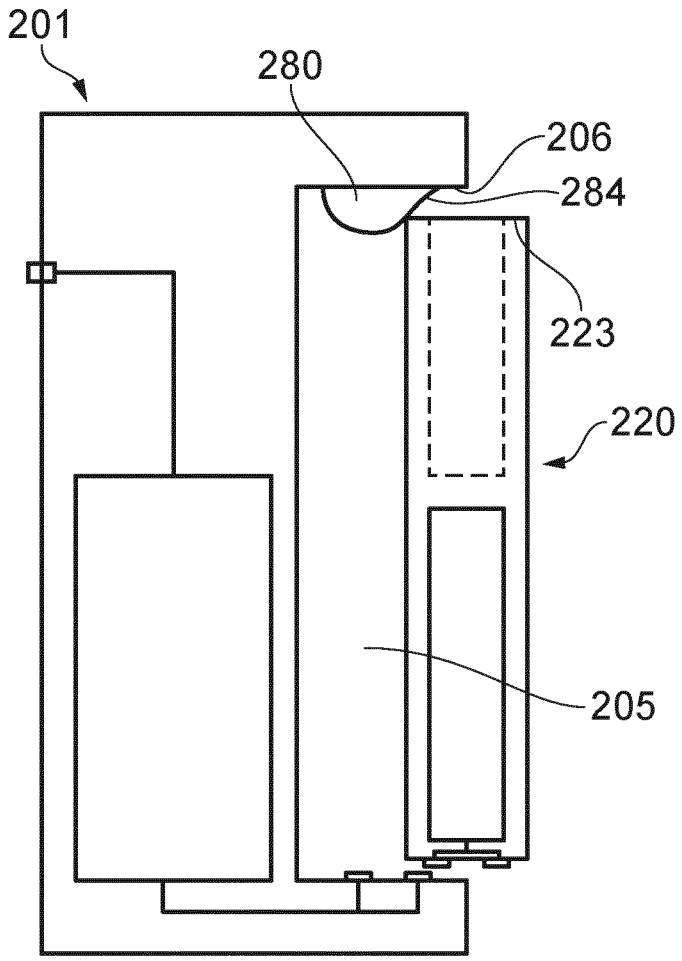
FIG. 2 is a schematic illustration the aerosol-generating device and the holder of FIG. 1.

FIG. 2 is a schematic illustration the aerosol-generating device and the holder of FIG. 1.

Retention of the aerosol-generating device 220 in the docking space 205 is effected by relative movement of the device 220 and the docking space 205 in a direction perpendicular to the longitudinal dimension of the device 220.

In FIG. 2, the aerosol-generating device 220 is partially accommodated in the docking space 205 of the holder 201. As can be seen in FIG. 2, the proximal end 223 of the device 220 is in contact with the retainer 280. This contact is causing the second surface 284 of the retainer 280 to deflect relative to the first end 206.

Figure 3:
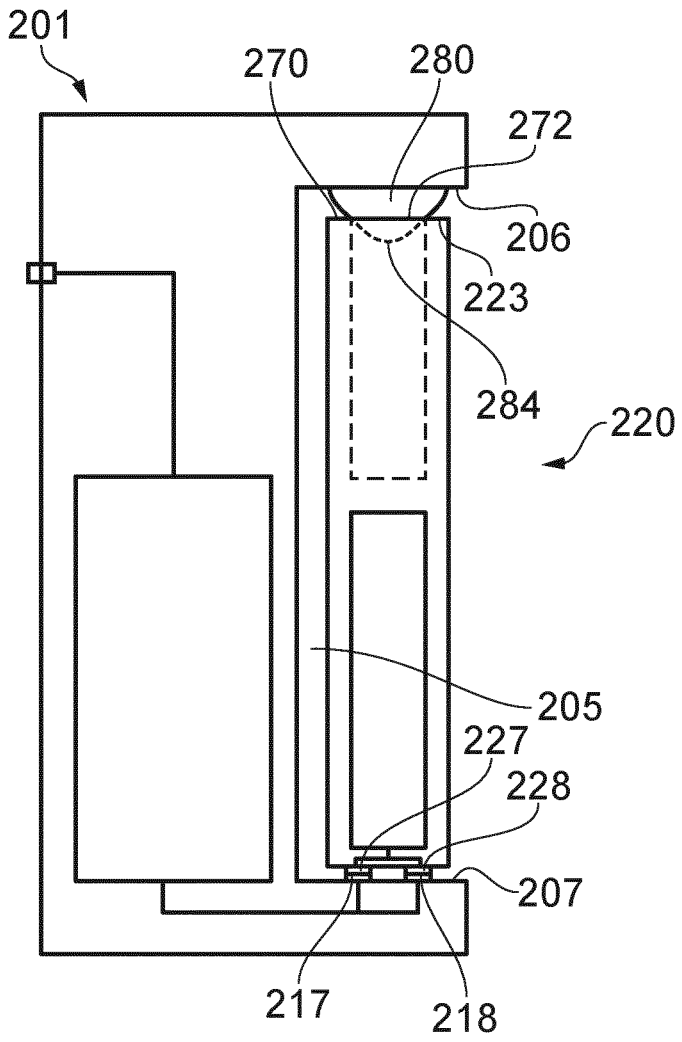
FIG. 3 is a schematic illustration the aerosol-generating device and the holder of FIG. 2.

FIG. 3 is a schematic illustration the aerosol-generating device and the holder of FIG. 2.

In FIG. 3, the aerosol-generating device 220 is accommodated in the docking space 205 of the holder 201. As can be seen in FIG. 3, the proximal end 223 of the device 220 is in engagement with the retainer 280. In this position, the retainer 280 is acting to releasably retain the device 220 in the docking space 205.

In the position shown in FIG. 3, a seal is formed by the interaction between the second surface 284 of the retainer 280 and the rim 270 of the device 220. This seals the opening 272 at the proximal end 223 of the device 220. In the example shown in FIG. 3, the second surface 284 of the retainer 280 forms a continuous, circumferential ring of contact with the continuous rim 270 bounding the opening 272 at the proximal end 223 of the device.

When the device 220 is accommodated in the docking space 205, as shown in FIG. 3, the retainer 280 is in a deformed or deflected state. In the position shown in FIG. 3, the second surface 284 has deflected relative to the first end 206. This is because a portion of the retainer 280 has been received in the opening 272 of the device 220. Another portion of the retainer 280 is not received in the opening 272 but is located above the opening 272. The retainer 280 is effectively squashed, or deformed, when the device 220 is accommodated in the docking space 205. Due to the resilience of the retainer 280, the retainer 280 applies a force to the device 220 accommodated in the docking space 205. This force urges the device 220 away from the first end 206 and towards the second end 207. In this way, the retainer 280 acts to releasably retain the device 220 in the docking space 205 and also to urge the device charging contacts 227, 228 towards the first and second charging contacts 217, 218 of the holder. This ensures a good electrical connection between device charging contact 227 and the first charging contact 217, and between device charging contact 228 and the second charging contact 218.

The invention claimed is:

1. A holder for an aerosol-generating device, the holder comprising:

a docking arrangement configured to engage with the aerosol-generating device, the docking arrangement comprising a docking space defined between a first end and an opposing second end spaced from and fixed relative to the first end, the docking space being configured to accommodate a longitudinal dimension of the aerosol-generating device; and a retainer configured to engage with an end of the aerosol-generating device to releasably retain the aerosol-generating device in the docking space, the retainer having a first surface fixed relative to the first end, and a second surface projecting away from the first end into the docking space, the second surface being deflectable relative to the first end on engagement with the end of the aerosol-generating device, wherein the second surface of the retainer comprises, or is formed from, a resiliently deformable elastic or elastomeric material, wherein the resiliently deformable elastic or elastomeric material comprises, or is, a nitrile, and resilient deformation of the resiliently deformable elastic or elastomeric material allows the second surface of the retainer to be deflectable relative to the first end, wherein an opening or recess is defined at the end of the aerosol-generating device, the opening or recess being bounded by a rim or lip, wherein the retainer is further configured such that, when the aerosol-generating device is retained in the docking space, a seal is formed by interaction between the second surface of the retainer and the rim or lip, wherein the opening or recess is configured to receive an aerosol-generating article, wherein the second surface of the retainer is substantially hemispherical in shape, wherein the second end comprises an electrical contact, and wherein the second surface of the retainer is further configured to contact an aerosol-generating device retained in the docking space to apply a force to urge the aerosol-generating device away from the first end and towards the second end.

2. The holder according to claim 1, wherein the retainer is formed from the resiliently deformable elastic or elastomeric material, and the first surface of the retainer is a first surface of the resiliently deformable elastic or elastomeric material.

3. The holder according to claim 1, wherein the retainer comprises, or is formed from, a nitrile rubber.

4. The holder according to claim 1, wherein the retainer is further configured to engage with the opening or recess defined at the end of the aerosol-generating device.

5. The holder according to claim 4, wherein the retainer engages with the rim or lip.

6. The holder according to claim 5, wherein the rim or lip is a continuous rim or lip bounding the opening or recess.

7. The holder according to claim 1, wherein the aerosol-generating device is an elongate aerosol-generating device defining a longitudinal dimension, and the docking space is configured to accommodate the longitudinal dimension of the elongate aerosol-generating device.

8. The holder according to claim 1, wherein retention of the aerosol-generating device in the docking space is effected by relative movement of the aerosol-generating device and the docking space in a direction perpendicular to the longitudinal dimension of the aerosol-generating device.

9. The holder according to claim 8, wherein the retention of the aerosol-generating device in the docking space causes elastic deformation of the retainer.

10. The holder according to claim 9, wherein the retainer is in a first state when the aerosol-generating device is not retained in the docking space, and the retainer is in a deformed second state when the aerosol-generating device is retained in the docking space.

11. The holder according to claim 1, further comprising a power source, wherein the electrical contact is electrically connected to the power source, the electrical contact configured to engage with a corresponding electrical contact of the aerosol-generating device to supply power from the power source to the aerosol-generating device when the aerosol-generating device is retained in the docking space.

12. The holder according to claim 11, wherein, when the aerosol-generating device is retained in the docking space, the retainer urges the aerosol-generating device towards the electrical contact.

13. The holder according to claim 1, wherein the aerosol-generating device comprises a body extending between a proximal end and a distal end, and wherein, when the aerosol-generating device is accommodated in the docking space, a first side portion of the body faces the holder and a second side portion of the body faces away from the holder and is exposed.

14. A system comprising the holder according to claim 1 and the aerosol-generating device.

15. The system according to claim 14, wherein the aerosol-generating device defines a cavity accessible through the opening or recess, and wherein the cavity is configured to receive the aerosol-generating article.

16. The system according to claim 14, wherein the aerosol-generating device comprises a heater element located in a chamber accessible through the opening or recess.

17. The system according to claim 14, wherein the aerosol-generating device defines a cavity configured to receive the aerosol-generating article, the cavity being accessible through the opening or recess, and either:

the aerosol-generating device comprises one or more heating elements positioned around internal walls of the cavity, or the aerosol-generating device comprises one or more heating elements defined on a heating member that is located within the cavity and configured for insertion into the aerosol-generating article, or the aerosol-generating device comprises one or more induction coils located around the walls of the cavity to inductively heat a susceptor within the cavity or within the aerosol-generating article inserted into the cavity.

* * * * *